US010583660B2

(12) United States Patent
Voss et al.

(10) Patent No.: US 10,583,660 B2
(45) Date of Patent: Mar. 10, 2020

(54) PRINTHEAD DEVICE INCLUDING SHIPPING FLUID

(71) Applicant: HEWLETT-PACKARD DEVELOPMENT COMPANY, L.P., Spring, TX (US)

(72) Inventors: Curtis Voss, Corvallis, OR (US); Palitha Wickramanayake, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/263,883

(22) Filed: Jan. 31, 2019

(65) Prior Publication Data

US 2019/0160823 A1 May 30, 2019

Related U.S. Application Data

(63) Continuation of application No. 15/526,920, filed as application No. PCT/US2014/068046 on Dec. 2, 2014, now Pat. No. 10,195,861.

(51) Int. Cl.

| | |
|---|---|
| ***B41J 2/175*** | (2006.01) |
| ***B41J 2/195*** | (2006.01) |
| ***B41J 2/165*** | (2006.01) |
| ***B41J 2/14*** | (2006.01) |

(52) U.S. Cl.

CPC ..... *B41J 2/17513* (2013.01); *B41J 2/14129* (2013.01); *B41J 2/165* (2013.01); *B41J 2/195* (2013.01); *B41J 2002/16502* (2013.01)

(58) Field of Classification Search

CPC .... B41J 2/17513; B41J 2/14129; B41J 2/165; B41J 2/195; B41J 2002/16502; B41J 2/17533; B41J 2/1707; B41J 2/17536

See application file for complete search history.

(56) References Cited

U.S. PATENT DOCUMENTS

| | | | |
|---|---|---|---|
| 5,341,160 | A | 8/1994 | Winslow et al. |
| 6,183,075 | B1 | 2/2001 | Sasaki |
| 6,533,405 | B1 | 3/2003 | Sieger |
| 7,153,352 | B2 | 12/2006 | Ogawa |
| 7,866,805 | B2 | 1/2011 | Furukawa |
| 8,596,746 | B2 | 12/2013 | Curcio et al. |
| 2006/0221149 | A1 | 10/2006 | Iwasaki |

(Continued)

FOREIGN PATENT DOCUMENTS

| | | |
|---|---|---|
| CN | 102378691 | 3/2012 |
| JP | 5201001 | 8/1993 |

(Continued)

OTHER PUBLICATIONS

IP.com search (Year: 2019).*

(Continued)

*Primary Examiner* — Lisa Solomon
(74) *Attorney, Agent, or Firm* — HP Inc. Patent Department

(57) ABSTRACT

A printhead device includes firing chambers, nozzles, and shipping fluid. The shipping fluid includes a shipping fluid density and a shipping fluid viscosity greater than a corresponding ink density and ink viscosity of an ink that will be ejected from the firing chambers and through the nozzles.

15 Claims, 5 Drawing Sheets

(56) References Cited

U.S. PATENT DOCUMENTS

| | | | |
|---|---|---|---|
| 2007/0035574 | A1 | 2/2007 | Taga |
| 2008/0265211 | A1 | 10/2008 | Rehman |
| 2010/0149268 | A1 | 6/2010 | Silverbrook |
| 2011/0310181 | A1 | 12/2011 | Curcio |
| 2013/0010036 | A1 | 1/2013 | Conner et al. |
| 2014/0313265 | A1 | 10/2014 | Himura |

FOREIGN PATENT DOCUMENTS

| | | | | |
|---|---|---|---|---|
| JP | 2000094705 | | 4/2000 | |
| JP | 2000094708 | | 4/2000 | |
| JP | 2004066599 | | 3/2004 | |
| JP | 2004-359944 | | 12/2004 | |
| JP | 4555602 | | 10/2010 | |
| JP | 4927648 | | 5/2012 | |
| WO | WO-2010114516 | A1 * | 10/2010 | ..... B41J 2/1707 |

OTHER PUBLICATIONS http://ieeexplore.ieee.org/xpl/articleDetails.jsp?tp=&arnumber=5349802&queryText%3DDynamics+of+entrained +air+bubbles +inside+a+piezodriven+inkjet+printhead > Author: Sang, J.L. et al.—Date: Dec. 8, 2009 Title: Dynamics of Entrained Air Bubbles Inside a Piezodriven Inkjet Printhead.

* cited by examiner

PRINTHEAD DEVICE INCLUDING SHIPPING FLUID

BACKGROUND

Printing systems include printhead devices to eject ink therefrom. The printhead devices may include inkjet printheads, page-wide printing arrays, and the like. The printhead devices may be manufactured, stored, and shipped to customers.

BRIEF DESCRIPTION OF THE DRAWINGS

The present embodiments will now be described, by way of example, with reference to the accompanying drawings, in which.

DETAILED DESCRIPTION

Printing systems include printhead devices to provide ink to media to form printed images. Printing devices may include removable inkjet printheads, page-wide printing arrays such as printheads coupled to print bars, and the like. Printing devices may be subjected to unwanted, vibration-induced, air ingestion and/or pigment settling defects during shipping and/or storage. Accordingly, unwanted air ingestion; intermixing between shipping fluid and ink; and pigment settling may result in printhead device defects.

In examples, a printhead device includes a plurality of firing chambers, a plurality of nozzles in fluid communication with the plurality of firing chambers, respectively, and a shipping fluid disposed throughout the printhead device including the plurality of firing chambers. The shipping fluid includes a shipping fluid density and a shipping fluid viscosity greater than a corresponding ink density and ink viscosity of an ink that will be ejected from the firing chambers and through the nozzles. For example, a ratio of the shipping fluid density to the ink density may be at least 1.009. Further, the shipping fluid viscosity is greater than the ink viscosity to enable the use of lower density shipping fluids to increase potential formulation options.

Thus, unwanted, vibration-induced, air ingestion and/or pigment settling defects during shipping and/or storage is reduced due to the shipping fluid density being greater than the ink density and the shipping fluid viscosity being greater than the ink viscosity. Also, the ink is positioned (e.g., floats) on top of the shipping fluid to reduce unwanted intermixing of the shipping fluid and ink, when the ink is supplied to the printhead device. Further, the clogging of the printhead device due to pigment settling is reduced. Thus, printhead device defects are reduced.

Figure 1:
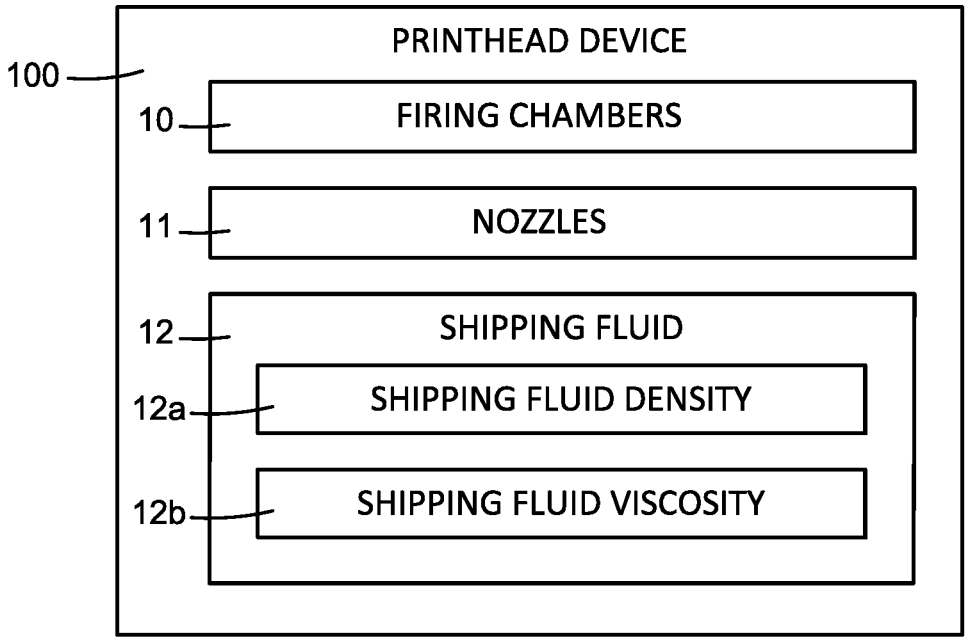
FIG. 1 is a block diagram illustrating a printhead device according to an example.

FIG. 1 is a block diagram illustrating a printhead device according to an example. Referring to FIG. 1, in some examples, the printhead device 100 includes a plurality of firing chambers 10, a plurality of nozzles 11, and a shipping fluid 12. The firing chambers 10 are in fluid communication with the nozzles 11, respectively. The shipping fluid 12 is disposed within the plurality of firing chambers 10. The shipping fluid 12 includes a shipping fluid density 12*a* and a shipping fluid viscosity 12*b* greater than a corresponding ink density and ink viscosity of an ink that will be ejected from the firing chambers 10 and through the nozzles 11

In some examples, the manufacturing of the printhead device 100 includes filling it with shipping fluid 12. Thus, the shipping fluid 12 will remain inside the printhead device 100 during the storage and shipment thereof. Subsequently, ink is supplied to the printhead device 100, for example, from a removable ink supply to enable the printhead device 100 to form printed images on objects such as media. The mixing of the shipping fluid and the ink within the printhead device 100, and the ingestion of unwanted air into the printhead device 10 is reduced due to the shipping fluid density 12*a* being greater than the ink density and the shipping fluid viscosity 12*b* being greater than the ink viscosity.

Figure 2:
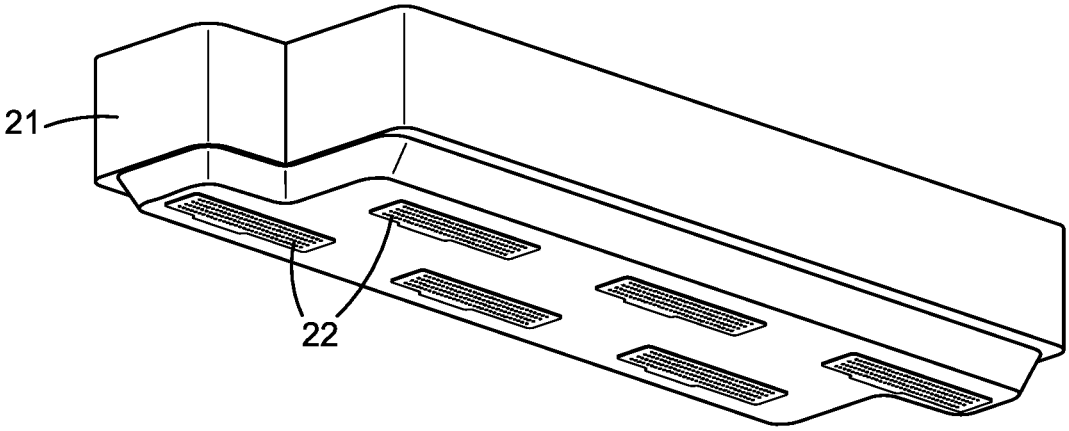
FIG. 2 is a perspective view illustrating a printhead device according to an example.
Figure 3A:
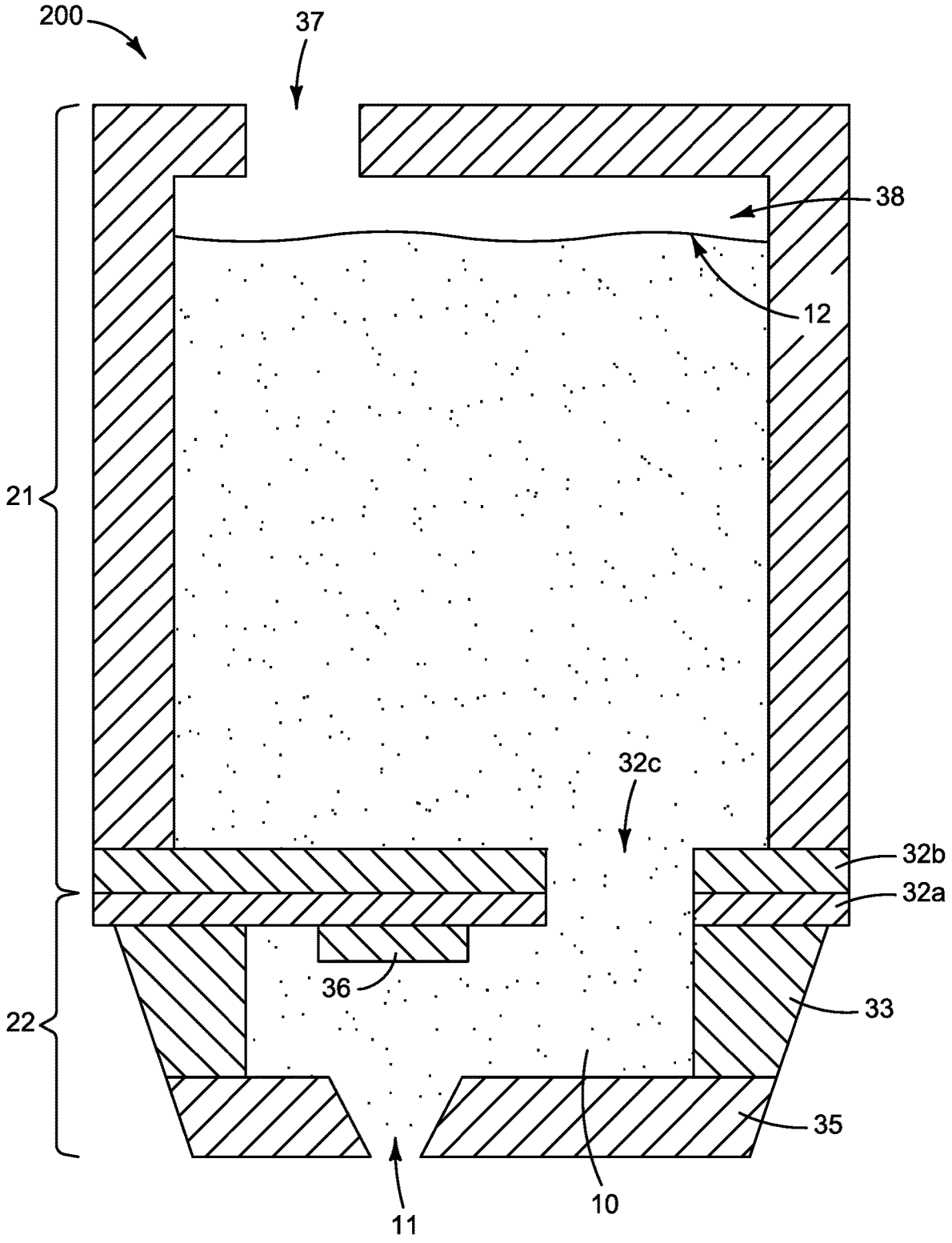
FIGS. 3A-3B are schematic views illustrating the printhead device of FIG. 2 according to examples.
Figure 3B:
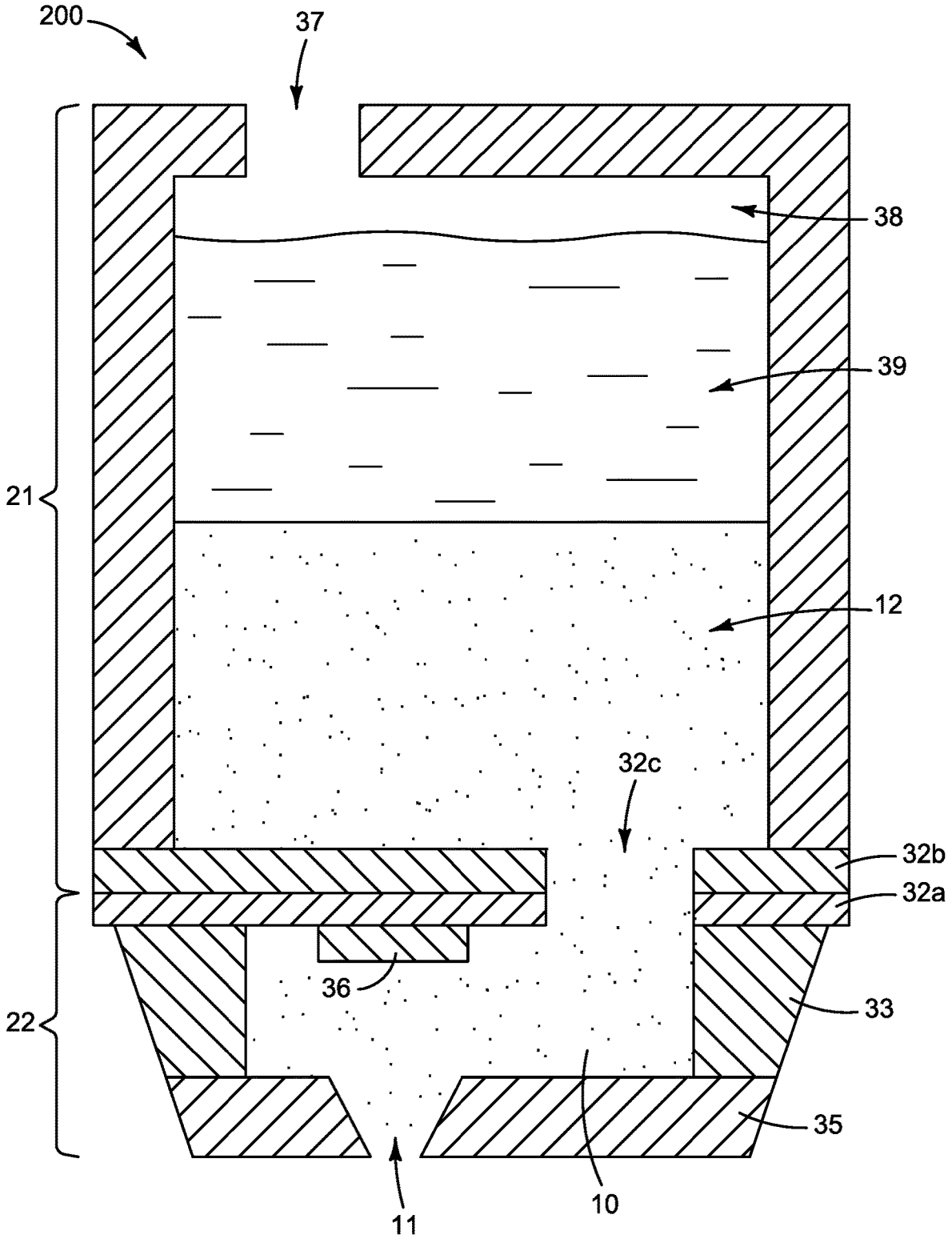

FIG. 2 is a perspective view illustrating a printhead device according to an example. FIGS. 3A and 3B are schematic views illustrating the printhead device of FIG. 2 according to examples. Referring to FIGS. 2-3B, in some examples, the printhead device 200 may include a page-wide inkjet printing array. That is, the printhead device 200 may include a print bar 21 and a plurality of printheads 22 coupled to the print bar 21. In some examples, the print bar 21 includes an inlet port 37 and a main fluid channel 38. The inlet port 37 receives ink from a removable ink supply (not illustrated) such as a removable ink container. The main fluid channel 38 provides the ink received from the removable ink supply through the inlet port 37 to the printheads 22 coupled to the print bar 21.

Referring to FIGS. 2-3B, in some examples, the printhead 22 includes the plurality of firing chambers 10, the plurality of nozzles 11, and the shipping fluid 12 as previously discussed with respect to the printhead device 100 of FIG. 1. In some examples, the printhead 22 also includes a printhead substrate 32*a*, a chamber layer 33, firing chambers 10, and a nozzle layer 35. In some examples, the chamber layer 33 forms side walls of the respective firing chambers 10. Further, the printhead substrate 32*a* and nozzle layer 35 form the bottom and top of the firing chamber 10, respectively.

Referring to FIGS. 2-3B, in some examples, a respective firing chamber 10 includes a thermal resistor 36. The thermal resistor 36 rapidly heats a fluid such as ink above its boiling point causing vaporization of the fluid resulting in ejection of a fluid drop. That is, the thermal resistor 36 generates a force utilized to eject essentially a fluid drop of the fluid stored in the firing chamber 10. Thus, activation of the respective thermal resistor 36 in response to a firing signal results in the ejection of a precise quantity of fluid in the form of a fluid drop. The nozzle layer 35 includes a plurality of nozzles 11.

Referring to FIGS. 2-3B, in some examples, the print bar 21 includes an inlet port 37, a main fluid channel 38, and a print bar substrate 32*b*. The print bar substrate 32*b* includes a plurality of inlet passages 32*c* to fluidically couple the respective firing chambers 10 with the main fluid channel 38. In some examples, the printhead substrate 32*a* may include integrated circuitry and be mounted to the print bar substrate 32*b*.

In some examples, the shipping fluid 12 is stored in the print bar 21 and the printheads 22. For example, the shipping fluid 12 may be placed in the main fluid channel 38, the firing chambers 10, and/or the nozzles 11. In some examples, the shipping fluid 12 includes water and chemical components. The chemical components are included to achieve the desired properties of the shipping fluid 12 such as a respective shipping fluid density 12*a*, a shipping fluid viscosity 12*b*, and a shipping fluid surface tension, while being compatible with the ink and jettable from the printhead with minimum nozzle health issues.

For example, the shipping fluid 12 may include 20-60% co-solvents, biocides, relatively small amounts of buffers, and other additives, colorants, and the a remainder of water. Further, the shipping fluid 12 may include 1-10% 2-Pyrrolidinone, 10-50% Trimethylolpropane, and 1-10% Triethyleneglycol as the co-solvents, 0.1-1% buffers, 0.01-0.5% biocides, and 0.1-3% of dyes as colorants. Still yet, the shipping fluid 12 may include 5% 2-Pyrrolidinone, 35% Trimethylolpropane, and 5% Triethyleneglycol as the cosolvents, 0.5% 2-Amino-2-methyl-1,3-Propanediol as the buffer, 0.20% Acticide B20 and 0.07% Acticide M20 as biocides, and 1.1% Direct Blue 199-Na as the dye colorant, and the like.

In some examples, the properties of the shipping fluid 12 include a shipping fluid density 12*a* being greater than the ink density, a shipping fluid viscosity 12*b* being greater than the ink viscosity, and a shipping fluid surface tension being greater than the ink surface tension. Thus, unwanted, vibration-induced, air ingestion; pigment settling; and intermixing of the shipping fluid 12 and ink are reduced. Accordingly, printhead device defects are reduced.

Referring to FIG. 3B, in some examples, ink 39 is added to the printhead device 200, for example, through a removable ink supply (not illustrated). When the ink is initially introduced therein, the ink 39 and the shipping fluid 12 are stored in the printhead device 200. The ink 39, however, having a lower ink density than the shipping fluid density 12*a* and a lower ink viscosity than the shipping fluid viscosity 12*b* enables the ink 39 to float on top of the shipping fluid 12. Thus, unwanted intermixing of the shipping fluid 12 and the ink 39 is reduced. In some examples, the shipping fluid density is greater than 1.06 grams per milliliter, the shipping fluid viscosity is greater than 3.5 centipoise, and the shipping fluid surface tension is greater than 42 dynes per centimeter. Further, in some examples, a ratio of the shipping fluid density to the ink density is at least 1.009.

Figure 4:
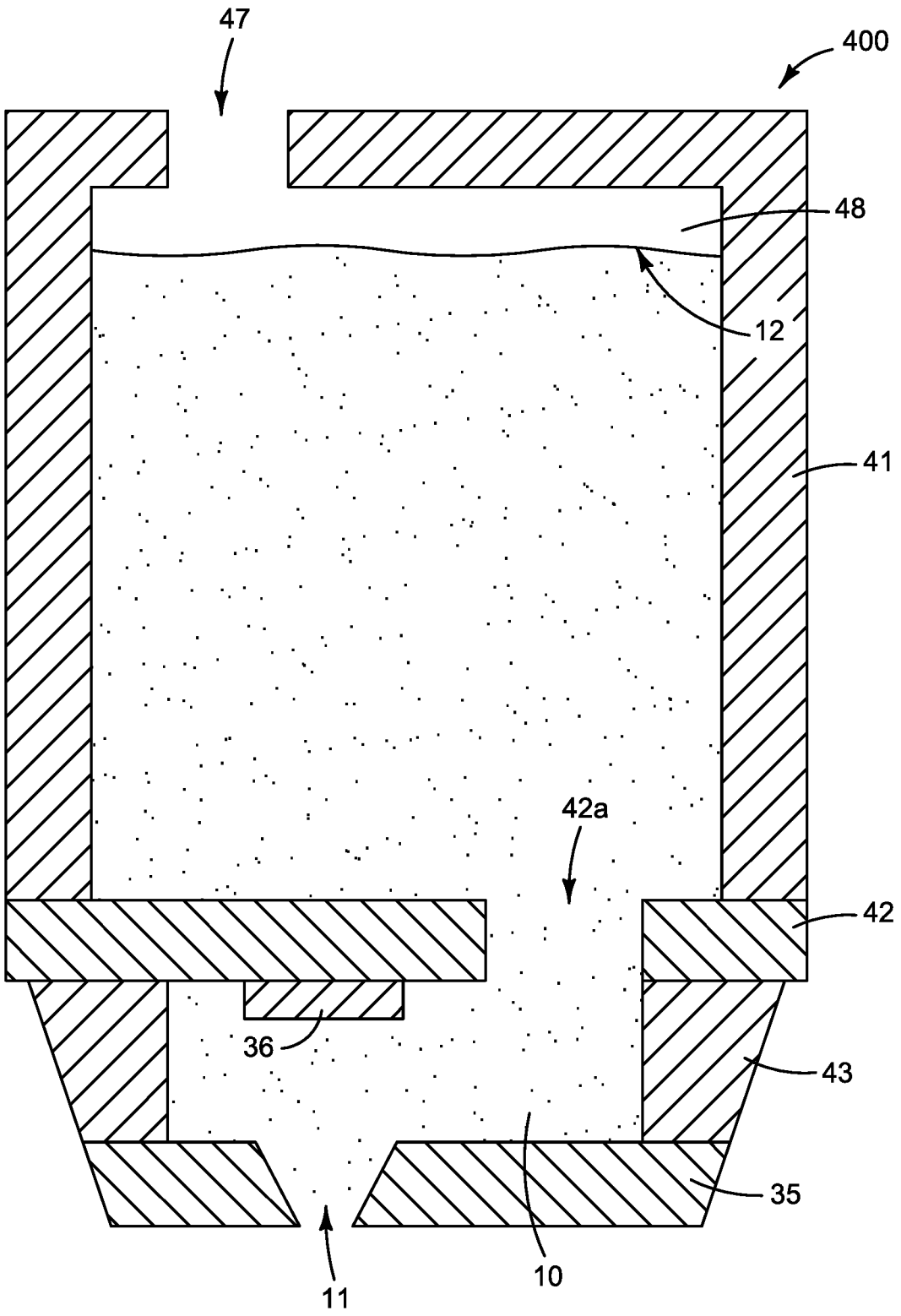
FIG. 4 is a schematic view of a printhead device according to an example.

FIG. 4 is a schematic view illustrating a printhead device according to an example. Referring to FIG. 4, in some examples, the printing device 400 includes the plurality of firing chambers 10, a plurality of nozzles 11, and a shipping fluid 12 as previously discussed with respect to the printhead device 100 of FIG. 1. In some examples, the printhead device 400 includes a pen body 41, a substrate 42, a chamber layer 43, a plurality of firing chambers 10, and a nozzle layer 35. The pen body 41 includes a fluid reservoir 48. The pen body 41 includes an inlet port 47 to receive ink from an ink supply (not illustrated) such as a removable ink container. The ink in the fluid reservoir 48 is subsequently provided to a firing chamber 10. In some examples, the chamber layer 43 forms side walls of the respective firing chambers 10. Further, the substrate 42 and nozzle layer 35 form the bottom and top of the firing chamber 10, respectively. The substrate 42 includes a plurality of inlet passages 42*a* in fluid communication with the firing chambers 10. Each firing chamber 10 may include a thermal resistor 36.

The thermal resistor 46 rapidly heats a component in the fluid such as ink above its boiling point causing vaporization of the fluid resulting in ejection of a fluid drop. That is, the thermal resistor 48 generates a force utilized to eject essentially a fluid drop of fluid held in the respective firing chamber 10. Thus, activation of the respective thermal resistor 36 in response to a firing signal results in the ejection of a precise quantity of fluid in the form of a fluid drop. The fluid reservoir 48 is fluidically coupled to the firing chambers 10 via the corresponding inlet passages 42*a*. The nozzle layer 35 includes a plurality of nozzles 11.

In some examples, the shipping fluid 12 is stored in the printing device 400. For example, the shipping fluid 12 may be placed in the fluid reservoir 48, the firing chambers 10, and/or the nozzles 12. In some examples, the shipping fluid 12 may be placed in each one of the fluid reservoir 48, the firing chambers 10, and/or the nozzles 12. In some examples, the shipping fluid 12 is stored in the print bar 21 and the printheads 22. For example, the shipping fluid 12 may be placed in the fluid reservoir 48, the firing chambers 10, and/or the nozzles 12. In some examples, the shipping fluid 12 includes water and chemical components. The chemical components are included to achieve the desired properties of the shipping fluid 12 such as a respective shipping fluid density, a shipping fluid viscosity, and a shipping fluid surface tension, while being compatible with the ink.

For example, the shipping fluid 12 may include 20-60% co-solvents, biocides, relatively small amounts of buffers, and other additives, colorants, and the remainder water. Further, the shipping fluid 12 may include 1-10% 2-Pyrrolidinone, 10-50% Trimethylolpropane, and 1-10% Triethyleneglycol as the co-solvents, 0.1-1% buffers, 0.01-0.5% biocides, and 0.1-3% of dyes as colorants. Still yet, the shipping fluid 12 may include 5% 2-Pyrrolidinone, 35% Trimethylolpropane, and 5% Triethyleneglycol as the cosolvents, 0.5% 2-Amino-2-methyl-1,3-Propanediol as the buffer, 0.20% Acticide B20 and 0.07% Acticide M20 as biocides, and 1.1% Direct Blue 199-Na as the dye colorant, and the like.

In some examples, the properties of the shipping fluid 12 include a shipping fluid density being greater than the ink density, a shipping fluid viscosity being greater than the ink viscosity, and a shipping fluid surface tension being greater than the ink surface tension.

Figure 5:
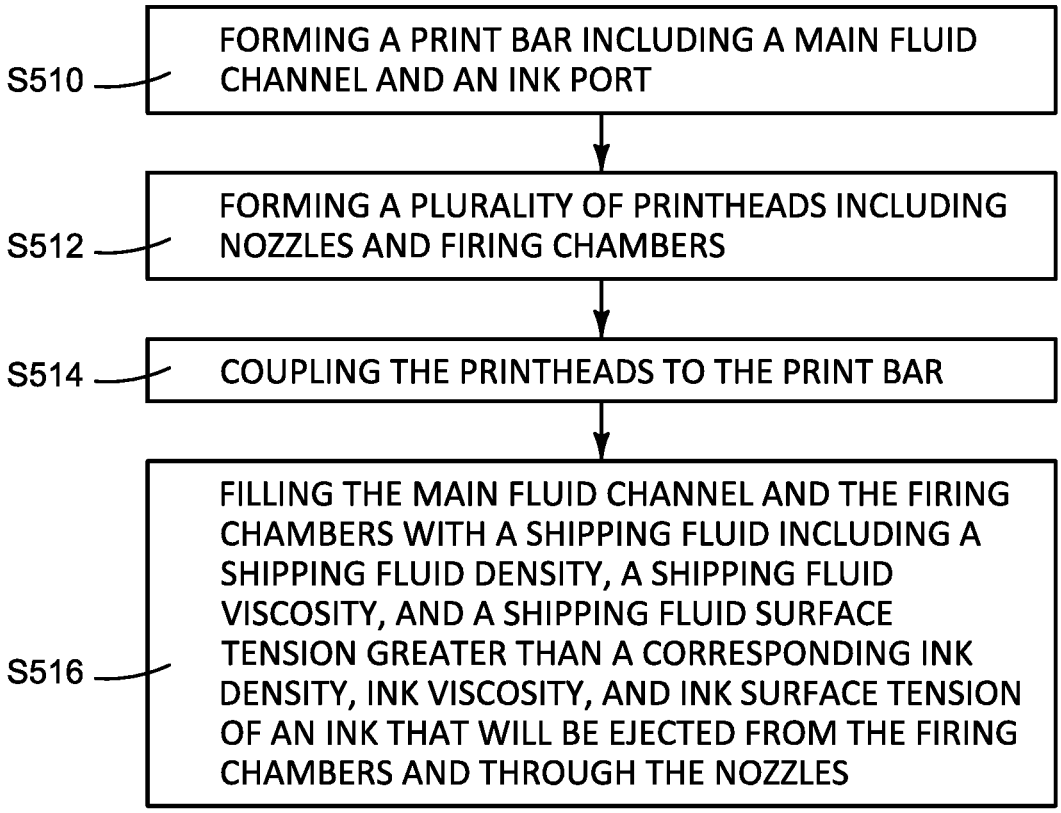
FIG. 5 is a flowchart illustrating a method of fabricating a printhead device according to an example.

FIG. 5 is a flowchart of a method of fabricating a printhead device according to an example. The method is associated with examples of the printhead devices 100, 200, and 400 illustrated in FIGS. 1-4 and the related description above. In block S510, a print bar is formed including a main fluid channel and an ink inlet. In block S512, a plurality of printheads including nozzles, firing chambers, and nozzles are formed. In block S514, the printheads are coupled to the print bar. In block S516, the main fluid channel and the firing chambers are filled with a shipping fluid including a shipping fluid density, a shipping fluid viscosity, and a shipping fluid surface tension greater than a corresponding ink density, ink viscosity, and ink surface tension of an ink that will be ejected from the firing chambers and through the nozzles.

In some examples, the method also includes filling the nozzles with the shipping fluid. In some examples, the shipping fluid density is greater than 1.06 grams per milliliter, the shipping fluid viscosity is greater than 3.5 centipoise, and the shipping fluid surface tension is greater than 42 dynes per centimeter. The shipping fluid may include water and a plurality of chemical components to achieve the shipping fluid density being greater than 1.06 grams per milliliter, the shipping fluid viscosity being greater than 3.5 centipoise, and the shipping fluid surface tension being greater than 42 dynes per centimeter. In some examples, a ratio of the shipping fluid density to the ink density is at least 1.009.

It is to be understood that the flowchart of FIG. 5 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may be rearranged relative to the order illustrated. Also, two or more blocks illustrated in succession in FIG. 5 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A printhead device comprising:

a print bar to span the width of a print substrate;

a plurality of printheads coupled to the print bar, wherein the plurality of printheads comprises a plurality of firing chambers and a plurality of nozzles in fluid communication with the plurality of firing chambers; and a shipping fluid disposed within the plurality of firing chambers, the shipping fluid including a shipping fluid density and a shipping fluid viscosity greater than a corresponding ink density and ink viscosity of an ink that will be ejected from the firing chambers and through the nozzles.

2. The printhead device of claim 1, wherein the shipping fluid density is greater than 1.06 grams per milliliter (g/mL) and the shipping fluid viscosity is greater than 3.5 centipoise (cP).

3. The printhead device of claim 1, wherein a ratio of the shipping fluid density to the ink density is at least 1.009.

4. The printhead device of claim 1, wherein the shipping fluid further comprises:

a shipping fluid surface tension greater than a corresponding ink surface tension of an ink that will be ejected from the firing chambers and through the nozzles.

5. The printhead device of claim 1, wherein the shipping fluid density is greater than 1.06 grams per milliliter, the shipping fluid viscosity is greater than 3.5 centipoise, and a shipping fluid surface tension is greater than 42 dynes per centimeter.

6. The printhead device of claim 1, wherein the shipping fluid comprises:

water; and a plurality of chemical components to achieve the shipping fluid density greater than 1.06 grams per milliliter, the shipping fluid viscosity greater than 3.5 centipoise, and the shipping fluid surface tension greater than 42 dynes per centimeter.

7. The printhead device of claim 1, w herein the shipping fluid is disposed within the nozzles.

8. The printhead device of claim 1, wherein each one of the firing chambers further comprises:

a thermal resistor to selectively heat up in response to receiving a respective firing signal.

9. The printhead device of claim 1, wherein the print bar comprises a main fluid channel, and the plurality of printheads are in fluid communication with the main fluid channel.

10. The printhead device of claim 9, wherein the shipping fluid is disposed within the main fluid channel.

11. The printhead device of claim 1, wherein the shipping fluid comprises water.

12. The printhead device of claim 1, wherein the shipping fluid comprises 20-60% co-solvents.

13. The printhead device of claim 1, wherein the shipping fluid comprises a biocide.

14. The printhead device of claim 1, wherein the shipping fluid comprises:

1-10% 2-Pyrrolidinone, 10-50% Trimethylolpropane, and 1-10% Trimethylolpropane.

15. The printhead device of claim 1, wherein the shipping fluid comprises:

5% 2-Pyrrolidinone,

35% Trimethylolpropane, and

5% Triethyleneglycol, 0.5% 2-Amino-2-methyl-1,3-Propanediol, a biocide, and a dye colorant.

* * * * *